US005253977A

United States Patent [19]

Chaix

[11] Patent Number: 5,253,977

[45] Date of Patent: Oct. 19, 1993

[54] MULTISTAGE PUMP FOR TWO-PHASE EFFLUENTS

[75] Inventor: Jean-Edmond Chaix, Pierrevert, France

[73] Assignee: Technicatome Societe Technique Pour L'Energie Atomique, France

[21] Appl. No.: 805,100

[22] Filed: Dec. 10, 1991

[30] Foreign Application Priority Data

Dec. 14, 1990 [FR] France ..... 90 15698

[51] Int. Cl.[5] ..... F01D 1/04; F01D 9/04

[52] U.S. Cl. ..... 415/199.5; 415/199.4; 415/191; 29/447; 29/557; 29/889.7

[58] Field of Search ..... 415/198.1, 199.4, 199.5, 415/181, 183, 185, 191, 202, 214.1, 216.1, 169.1, 169.4; 416/198 R, 198 A; 29/447, 557, 889.7

[56] References Cited

U.S. PATENT DOCUMENTS

| | | | |
|---|---|---|---|
| 1,825,239 | 9/1931 | Meyer | 29/447 |
| 2,187,788 | 1/1940 | Kraft | 415/185 |
| 2,219,098 | 10/1940 | Dorer | 415/198.1 |
| 2,376,528 | 5/1945 | Wislicenus . | |
| 2,395,704 | 2/1946 | Wislicenus | 416/198 A |
| 2,591,488 | 4/1952 | Yost | 415/199.5 |
| 2,706,451 | 4/1955 | Mayer-Ortiz et al. | 416/198 A |
| 3,204,562 | 9/1965 | Norquist . | |
| 3,498,727 | 3/1970 | Martin, Jr. et al. | 415/136 |
| 3,955,860 | 5/1976 | Menke et al. | 415/111 |
| 4,116,583 | 9/1978 | Budris | 415/214.1 |
| 4,365,932 | 12/1982 | Arnaudeau | 415/199.5 |

FOREIGN PATENT DOCUMENTS

| | | | |
|---|---|---|---|
| 2320435 | 3/1977 | France . | |
| 0120701 | 7/1984 | Japan | 415/199.5 |
| 0123227 | 7/1985 | Japan | 29/447 |
| 622669 | 5/1949 | United Kingdom . | |

*Primary Examiner*—Edward K. Look
*Assistant Examiner*—Christopher M. Verdier
*Attorney, Agent, or Firm*—Pearne, Gordon, McCoy & Granger

[57] ABSTRACT

The axial pump makes it possible to deliver a fluid having a double gaseous-liquid phase at high flow rates. It is constituted by a one-piece rotor comprising a hollow shaft (10) onto which are shrunk pulsating systems (12). This rotor is placed within a body (2) constituted by a stack of washers (3) within which are fixed straighteners (14). Each straightener is constituted by two half-straighteners, so as to permit the installation of each straightener around the rotor. Everything is sealed by end flanges on which the rotor is mounted in rotary manner. The pulsating systems (12) can also be machined on the outer surface of the body (10).

6 Claims, 4 Drawing Sheets

MULTISTAGE PUMP FOR TWO-PHASE EFFLUENTS

BACKGROUND OF THE INVENTION

1. Field of the Invention

In general terms, the invention relates to all multistage pumps using a long rotor equipped with blades and in particular axial or helico-axial pumps used for pumping two-phase effluents. Reference is made to the pumping of the fluid constituted by a mixture of oil and oil gas in connection with the exploitation of oil fields and in particular ocean fields.

2. Description of the Related Art

In a recent process for the exploitation of ocean fields, the effluents, which contain both liquid and gaseous oil, are not treated on a platform installed in the immediate vicinity, but are instead discharged to the side or to a platform located at some distance therefrom. As these effluents are formed by a multiphase fluid, it is necessary to have power pump units able to discharge from a field several dozen $m^3$ of effluents every hour.

For this purpose use is made of two-phase multistage pumps which can be associated with a motor unit, with a view to permitting the discharge with a high flow rate of a two-phase or multiphase fluid such as oil effluents.

With reference to FIG. 2, these pumps are constituted by a rotor having a main shaft 100 to which are fixed pulsating systems 102. As can be seen in FIG. 2, each pulsating system 102 is fixed by means of a key 106 introduced into a slot formed for this purpose in the main shaft 100. This leads to a precise adjustment of the machining of the internal diameter of the pulsating system 102 with respect to the external diameter of the shaft 100, which is relatively expensive. As a result the rotor can be dismantled, but this makes the rotor difficult to balance after each pulsating system change. The invention aims at obviating this disadvantage by proposing a multistage pump with a different design with respect to the rotor.

SUMMARY OF THE INVENTION

To this end, the main objective of the invention is a multiphase pump comprising a main body sealed at both ends by an inlet flange and an outlet flange, a shaft placed in the main body and to which are fixed the pulsating systems and straighteners fixed within the main body and alternating with the pulsating systems.

According to the invention, the shaft and the pulsating systems constitute an independently produced one-piece assembly, which permits a simple installation and a precise balancing of the shaft and the pulsating systems constituting the pump rotor. Moreover, the central part of the main body has at least as many washers as there are stages.

In a first embodiment of the pump, the assembly constituted by the shaft and the pulsating systems is produced from a single piece in which the pulsating systems are machined. In a second embodiment of the pump, the pulsating systems are constituted by rings shrunk onto the shaft.

In a special embodiment of the pump according to the invention, each straightener is constituted by two half-rings inserted in the annular space separating two pulsating systems and held in the axial and angular position by washers, whose stacking constitutes the main body of the machine.

According to a preferred embodiment of the invention, the washers forming the main body are maintained in place between the inlet and outlet flanges by means of studs connecting said flanges.

Preferably, the shaft is a tube and is terminated at its ends by two journals, thereby making it possible to install the shaft so as to rotate freely in the main body by means of bearings.

The pump according to the invention is more particularly intended for the pumping of two-phase effluents.

The invention is described in greater detail hereinafter relative to non-limitative embodiments and the attached drawings.

BRIEF DESCRIPTION OF THE DRAWINGS

These and further objects of the invention will be apparent with reference to the following descriptions and drawings, wherein.

DETAILED DESCRIPTION OF THE PREFERRED EMBODIMENTS A CONSTRUCTION OF THE PUMP ACCORDING TO

Figure 1:
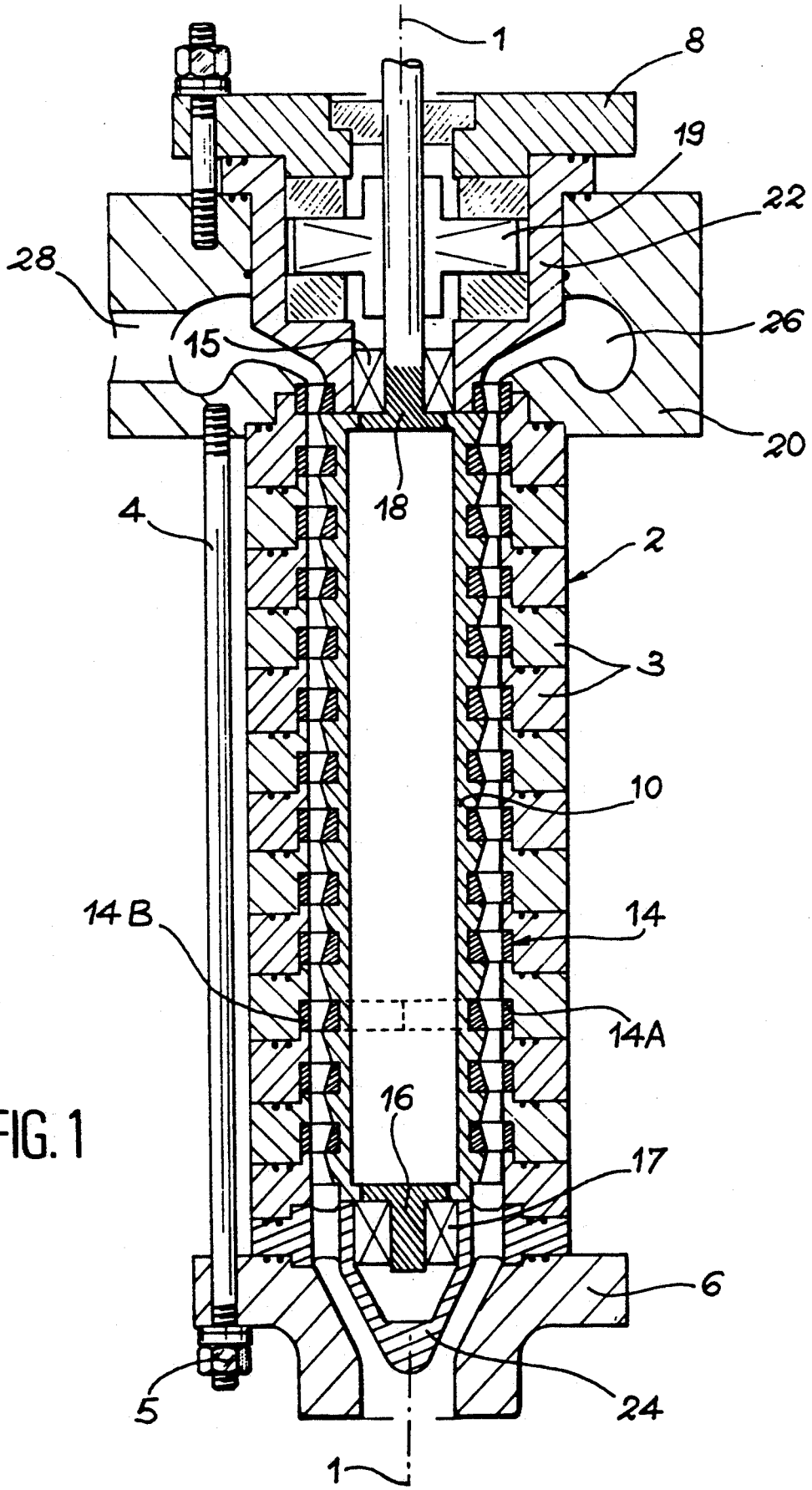
FIG. 1 shows in section the pump according to the invention.
Figure 2:
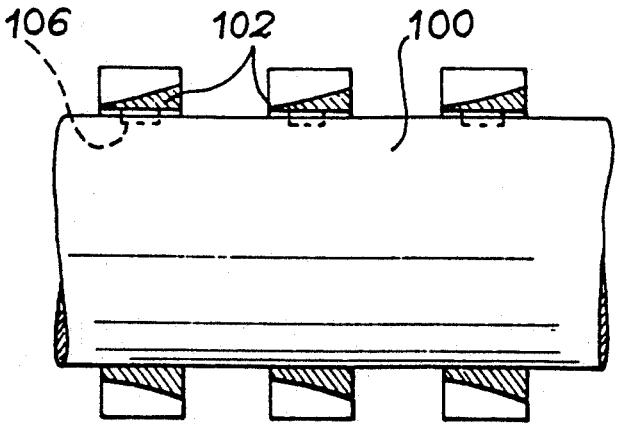
PRIOR ART FIG. 2
FIG. 2 shows the structure of the shaft of the prior art two-phase multistage pumps.

With reference to FIG. 1, the pump according to the invention comprises a pump body 2, which is a cylindrical assembly over most of its length. The pump rotor is mainly constituted by a shaft 10 mounted so as to rotate around the longitudinal axis 1 of the body 2. The latter is closed at its ends by flanges, namely the inlet flange 6 and the outlet flange 20. In order to minimize the weight of the rotor, the shaft 10 is in the form of a tube. Its two ends are constituted by two supporting journals 16,18 by means of which the shaft 10 is mounted in rotary manner around the body 2 via the two respective bearings 17 and 19. The pump is kept assembled by means of studs 4 screwed into a fixing ring 8 and locked by means of a nut 5 bearing on the inlet flange 6.

The pump is advantageously completed at one end by a box constituted by a ring 22 and the fixing ring 8, on whose internal diameter can bear the external fitting of the bearing 15 and the abutment 19 of said end. At the other end, the pump can be completed by a bush 24, which is centered on the pump axis 1. The outer ring of the bearing 17 corresponding to said end can bear on the internal diameter of the bush.

The motive force is communicated to the fluid by the pump by means of pulsating systems 12 integral with the shaft 10 and the straighteners 14, integral with the body 2 and intercalated between the pulsating systems 12. The channel created by the gap between the rotor constituted on the one hand by the shaft 10 and the pulsating systems 12 and on the other hand the stator constituted by the body 2 and the straighteners 14 defines the path of the fluid passing through the pump.

The outlet flange 20 has a cavity 26 placed at the outlet of said channel, so as to collect the fluid, thus permitting the discharge thereof by means of a discharge pipe 28.

In FIG. 1 the pulsating systems 12 of the rotor are shown by single hatching as forming an integral part of the shaft 10.

Therefore the thus formed rotor is in one-piece and can consequently not be dismantled. Once the rotor is mounted so as to rotate about a random rotation axis, it is consequently possible to dynamically and statically balance it, said balancing remaining fixed for the entire life of the rotor.

Figure 3A:
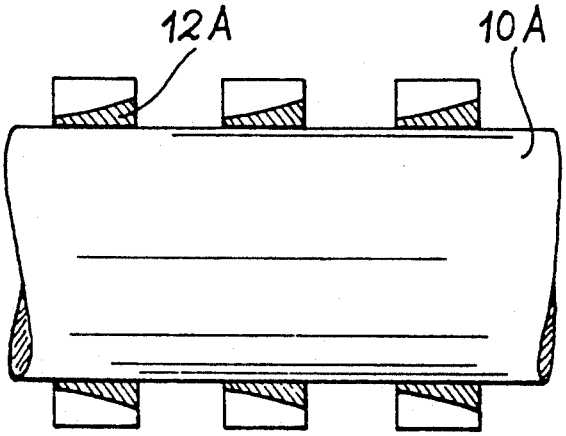
FIGS. 3A and 3B show the structure of the shaft of the pump according to the invention.

With reference to FIG. 3A, the installation of the pulsating systems 12A on the shaft 10A is brought about by obtaining a given external diameter for the shaft 10 and by the bore of each pulsating system 12A having a diameter equal to the external diameter of the shaft 10, so that each pulsating system 12 can be installed by sliding around the shaft 10 during hot shrinking, the pulsating systems 12 being expanded. The cooling thereof ensures their definitive fixing.

As a result of this one-piece structure, once the rotor has been balanced, it can reach rotation speeds higher than those of a rotor formed by pulsating systems installed by keying and without leading to vibrations. Speeds up to 7000 r.p.m. can be obtained by means of such a hollow shaft having an external diameter of approximately 240 mm.

It should also be noted that the structure of a tubular shaft leads to a considerable weight reduction, while maintaining a moment of inertia in rotation with respect to the longitudinal axis of the pump of a very high magnitude. The support journals 16,18 can also be fitted by shrinking.

Figure 3B:
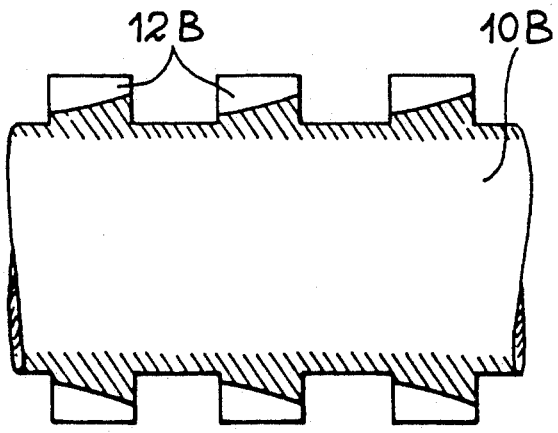

With reference to FIG. 3B, the pulsating systems 12B can form an integral part of the shaft 10B. In this case they are produced by machining a thick tube, whose initial diameter exceeds the external diameter of the pulsating systems 12B. The thus obtained rotor clearly has a one-piece structure with the same advantages as those of the rotor described relative to FIG. 3A. Preferably the pump body 2 is formed from washers 3 joined by studs 4.

Figure 4:
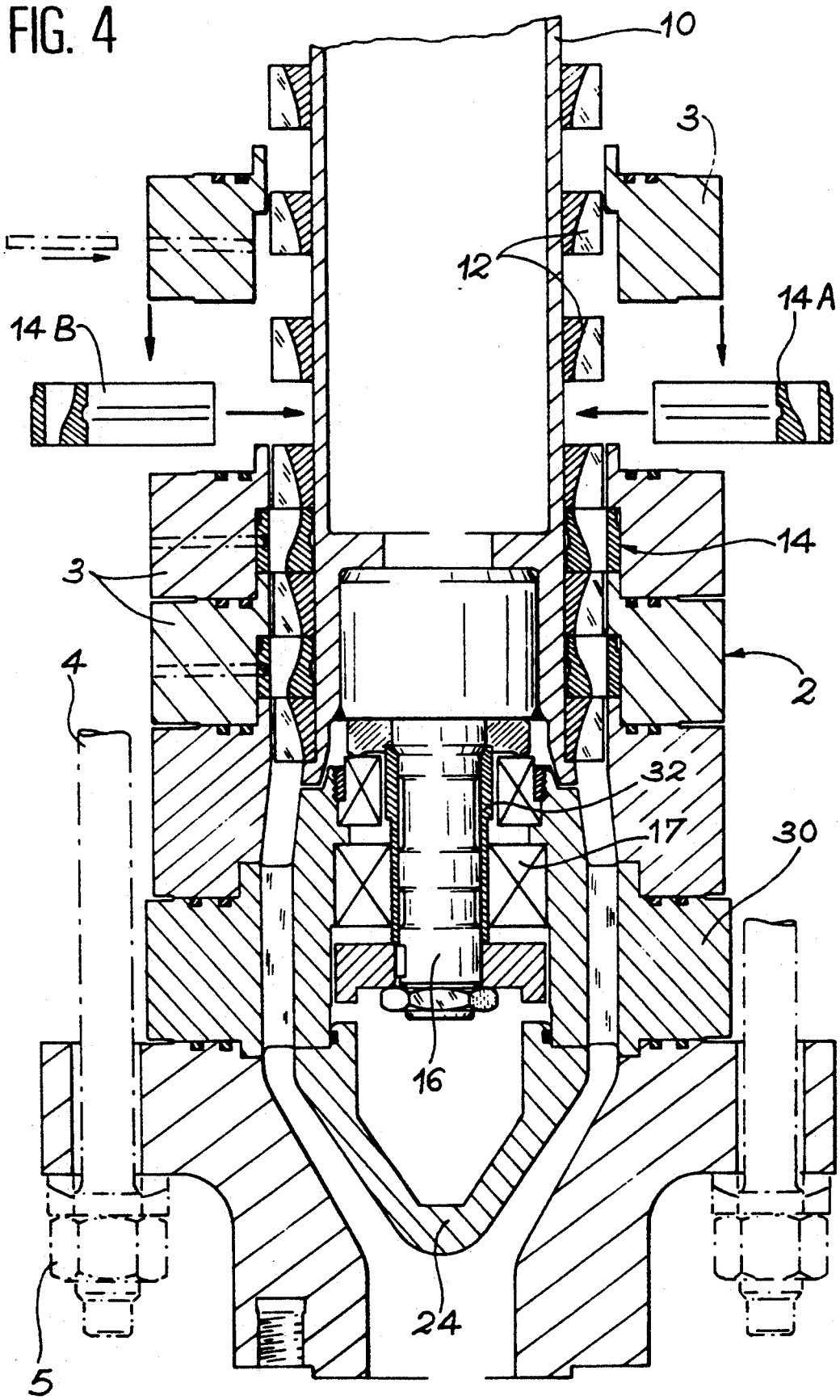
FIG. 4 is a more detailed section of part of the pump in order to explain its installation.

With reference to FIG. 4, the design of the pump according to the invention leads to several fitting advantages for the same. Thus, FIG. 4 shows the lower end of the pump with the rotor fitted in rotary manner in the final washer 30 of the stack of body 2 via a random bearing. The external ring of the latter bears on the final washer 30, the internal ring thereof bearing on a sleeve 32 shrunk onto the support journal 16. The bush 24 serves as a cover for this installation.

Figure 5:
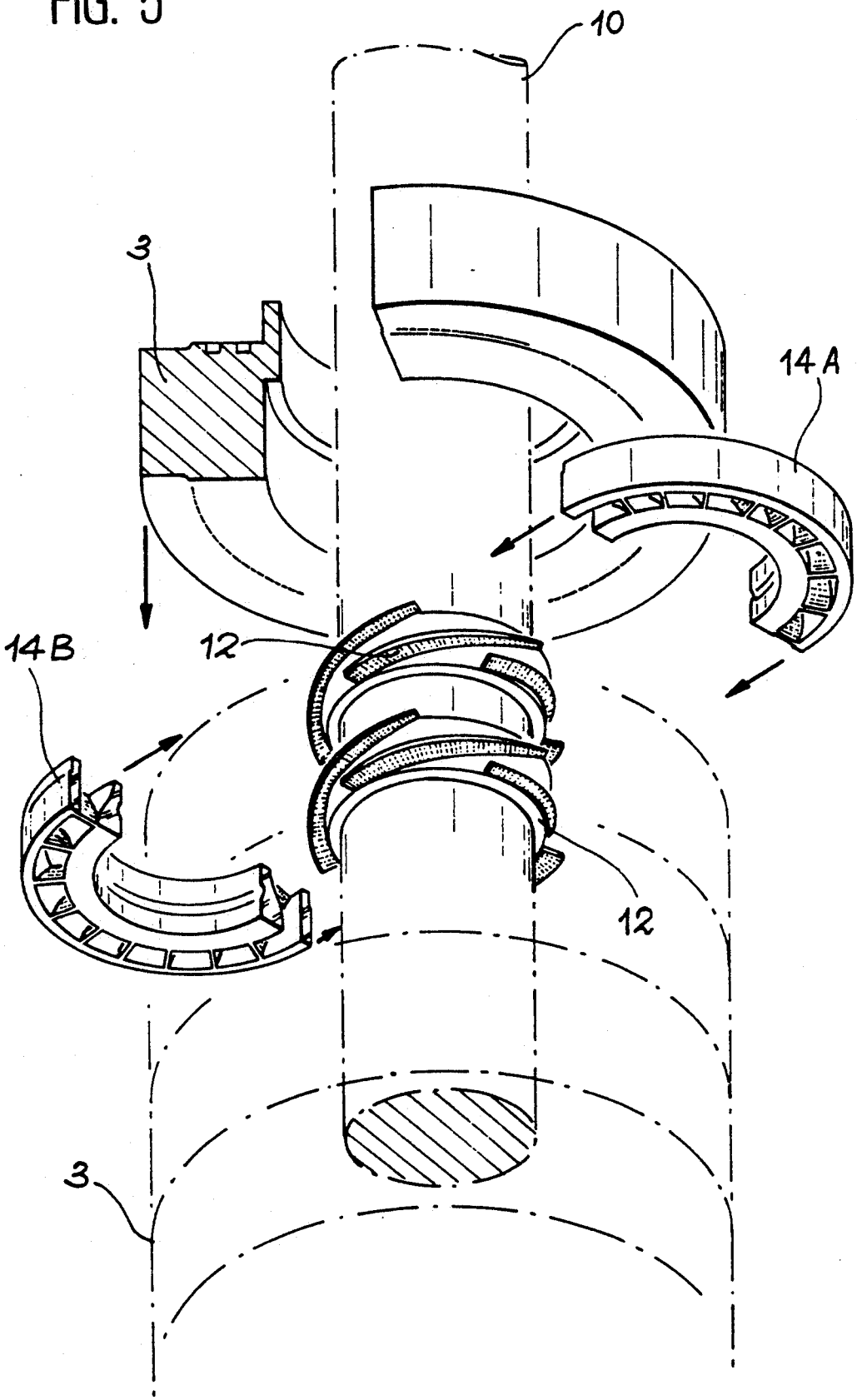
FIG. 5 is an exploded diagram showing the installation of the straighteners around the shaft of the pump according to the invention.

According to the invention, each of the straighteners 14 is formed by two half-straighteners 14A,14B, each having a semicircular shape. This makes it possible to fit each straightener by positioning on either side of the shaft 10 each of the said half-straighteners 14A,14B and then move them towards the shaft 10, as indicated by the two horizontal arrows. Each straightener is consequently intercalated between two pulsating systems 12. This operation is better illustrated by FIG. 5, where only the half-straighteners 14A,14B are shown in the position enabling them to be inserted between the two pulsating systems 12. It is also possible to see each of the washers 3 forming the pump body 2.

During installation, once the rotor has been fitted so as to form a one-piece assembly, the latter is surrounded by all the straighteners 14 secured by the washers 3 in the manner described hereinbefore.

Then, the assembly constituted by the rotor completed by the washers 3 containing the straighteners 14 is vertically mounted on the end parts 6 and 8 via the corresponding bearings. A washer 3 is then threaded onto the rotor, bears and is centered on the preceding washer and fixes the two half-straighteners in position. Each washer 3 locks in rotation the corresponding straightener 14 by means of an angular indexing. This type of installation is both simple and reliable.

The structure of the rotor makes it possible to achieve speeds of 7000 r.p.m. without exceeding the maximum critical speed of the said rotor with 12 to 15 stages, so that the pump according to the invention is particularly suitable for delivering oil in the form of a liquid phase and a gaseous phase at high flow rates.

I claim:

1. A multistage pump comprising a main body (2) having an inlet end and an outlet end, said inlet end being sealed by an inlet flange and said outlet end being sealed by an outlet flange, a shaft (10) placed in the main body (2) and to which are joined pulsating systems (12), and straighteners (14) fixed within the main body (2) and alternating with the pulsating systems (12), wherein the shaft (10) and the pulsating systems (12) form a one-piece assembly, each straightener (14) is constituted by two half-rings (14A, 14B) inserted in a washer (3) so as to permit their installation around the assembly constituted by the shaft (10) and the pulsating systems (12), and a central part of the main body (2) is constituted by at least as many washers (3) as there are stages.

2. A pump according to claim 1, wherein the assembly constituted by the shaft (10B) and the pulsating systems (12B) is produced from one piece in which the pulsating systems (12B) are machined.

3. A pump according to claim 1, wherein the pulsating systems (12A) are rings shrunk onto the shaft (10A).

4. A pump according to claim 1, wherein the flanges (6) and (20) are maintained at the ends of the main body by means of studs (4).

5. A pump according to claim 1, wherein the shaft (10) is a tube and is terminated at its ends by two support journals (16,18) permitting the installation of the shaft (10) so as to rotate freely in the main body (2) via bearings (17,19).

6. A pump according to claim 1, wherein the pump is used for pumping two-phase effluents.

* * * * *